US006902130B1

(12) United States Patent
Salem

(10) Patent No.: US 6,902,130 B1
(45) Date of Patent: Jun. 7, 2005

(54) MULTIPLE PURPOSE STORAGE REEL FOR CHRISTMAS LIGHTS

(76) Inventor: Rosa Brown Salem, 7522 N. Blossom Ave., Tampa, FL (US) 33614

( * ) Notice: Subject to any disclaimer, the term of this patent is extended or adjusted under 35 U.S.C. 154(b) by 630 days.

(21) Appl. No.: 09/663,436

(22) Filed: Sep. 16, 2000

Related U.S. Application Data

(60) Provisional application No. 60/155,121, filed on Sep. 22, 1999.

(51) Int. Cl.[7] ..... B65H 75/40; B65H 75/14

(52) U.S. Cl. ..... 242/395; 242/405.3; 242/407.1; 242/609.3

(58) Field of Search ..... 242/395, 395.1, 242/405.3, 405.2, 407.1, 609.3, 609.1

(56) References Cited

U.S. PATENT DOCUMENTS

| | | | | | |
|---|---|---|---|---|---|
| 591,290 | A | * | 10/1897 | Noll | 242/395 |
| 606,666 | A | * | 7/1898 | Hubner | 242/395 |
| 1,301,189 | A | * | 4/1919 | Steen | 242/395 |
| 1,419,589 | A | * | 6/1922 | Schaper | 242/395 |
| 3,006,309 | A | * | 10/1961 | Rowley | 242/395 |
| 3,179,351 | A | * | 4/1965 | Ehlert | 242/405.2 |
| 3,302,320 | A | * | 2/1967 | Breeden | 242/405.3 |
| 4,204,651 | A | * | 5/1980 | Haverland | 242/395 |
| 4,484,718 | A | * | 11/1984 | Jones-Fenleigh | 242/405.3 |
| 4,917,323 | A | | 4/1990 | Wing | |
| 5,064,067 | A | | 11/1991 | McAllister et al. | |
| 5,287,965 | A | | 2/1994 | Miller | |
| 5,598,985 | A | | 2/1997 | Winesett | |
| 5,868,334 | A | * | 2/1999 | Cedillo | 242/405.3 |
| 5,934,598 | A | * | 8/1999 | Kovacik et al. | 242/395 |
| 5,957,401 | A | | 9/1999 | O'Donnell | |
| 6,241,181 | B1 | * | 6/2001 | Campbell | 242/609.3 |

* cited by examiner

*Primary Examiner*—John M. Jillions

(57) ABSTRACT

A multiple purpose storage device for Christmas string of lights constructed of plastic molding. Device has two identical octagon shaped sides which twist snap together at a 90 degree angle to form a single component. A single unit molded handle with a non-restricted rotating lever snaps over a boss at each side of the reel just outside the center of the cylinder. A flexible tab facility is molded into the inner side of the reel to hold one end of a string of lights to wrap evenly around the cylinder by rotating a lever. The handle has a storage compartment at the top made with a living hinge for secure closure and easy opening. Device is assembled prior to shipping and is shipped in a sturdy corrugated cardboard box designed for storing reel and for handy stackable shelf storage.

1 Claim, 3 Drawing Sheets

MULTIPLE PURPOSE STORAGE REEL FOR CHRISTMAS LIGHTS

CROSS-REFERENCE TO RELATED APPLICATIONS

This application claims the benefit of Provisional Patent Application No. 60/155,121 filed Sep. 22, 1999.

BACKGROUND

1. Field of Invention

This invention relates to a hand held portable reel having multiple storage purposes, particularly for Christmas string of lights.

2. Description of Prior Art

Originally, holiday strings of lights or other light weight materials were wrapped around a device using inconvenient techniques, cumbersome designs, and storage disadvantages. However a lightweight, portable, and durable device was needed not just for winding holiday lights, or storing the lights for tangle free storage until the next year, but a device that would allow an individual to place or remove a string of lights onto tree branches by simply holding a reel in one hand and using the other hand to place light onto branches. Another need is a device that allows a string of lights to be wrapped, tangle free, onto a storage device directly off the tree. None of the hand reels known completely satisfy this need.

The Christmas light storage reel in U.S. Pat. No. 4,917, 323 to Don Wing 1990 Apr. 17, is not only limited to a manual wrapping of a string of lights, the device requires extensive back and forth hand motion from various sockets to pass through slots to complete the wrap process.

The Christmas light storage reel in U.S. Pat. No. 5,064, 067 to James D, and Molly J. McAllister, 1991 Nov. 12, is also limited to manual wrapping of a string of lights requiring care to ensure wired string of lights are inserted and hand guided between tooth like projections.

The Christmas light storage reel in U.S. Pat. No. 5,287, 965 to John E. Miller 1994 Feb. 22, is made of a gradual deteriorating material. The device is purchased unassembled and contains multiple corrugated cardboard pieces that the customer must put together.

The Christmas light storage reel in U.S. Pat. No. 5,598, 985 to Sandy C. Winesett 1997 Feb. 4, requires an object, such as a table, to be placed near a Christmas tree to place the device on in order to operate the crank for winding lights onto the cylinder. This device also limits an individual from being able to go around the tree to place lights onto tree branches. Normally, households have many strings of lights. Stacking other like reels on top of each other for shelf storage would require caution.

The Christmas light storage reel in U.S. Pat. No. 05,957, 401 to Patricia Sessum O'Donnell 1999 Sep. 28, is limited to manual wrapping a string of lights around a bulky spool. Additionally, to rotate a string of lights onto the spool, the device needs to be suspended on a stationary object, such as a ladder.

SUMMARY

The present invention is made of durable plastic injection molding. The reel is light weight, portable, affordable, hand held and that is able to store 200 miniature Christmas lights tangle free.

The primary object of the present invention is to provide a device that allows the customer to hold a reel in one hand while the other hand turns a rotating lever for a string of lights to coil around a cylinder for tangle free, convenient storage and decorating purposes.

Another object of the present invention is a storage compartment in the handle unit which has a living hinge for secure closure and easy opening. This compartment stores extra, single, miniature Christmas bulbs and offers easy access when burned out bulbs need to be replaced.

A further object is that the present invention can be used to place lights onto tree branches from the reel. Because of its lightweight, free flowing pull, lights can be situated onto the branches with one hand while holding the reel in the other hand.

A still further object is when the lights are to be removed off the tree, they can be wrapped directly onto the reel straight off the tree. The reel is stored in the provided sturdy corrugated cardboard box until next season.

OBJECTS AND ADVANTAGES

Accordingly, several objects and advantages my of my invention are:

a. Provides a portable hand held, lightweight, convenient storage reel;

b. Constructed of durable, long life, plastic injection molding;

c. Provides an unrestricted, rotating lever which allows a string of lights to wind easily;

d. Provides design and colors that are eye pleasing, enhancing the season's spirit. The sides of the reel are rich maroon in color and the handle lever component is brilliant gold in color. Both sides have a figure of an angel embossed into the plastic mold.

e. Provides a ready to use assembled device. The device is shipped in a sturdy durable corrugated cardboard box which is used to store the reel with lights into it until next season. The box is shaped for easy stacking on top of another box.

f. Provides octagon shaped side panels to allow the device to stand securely in an upright position.

g. Hand lever provides smooth unrestricted rotating of a string of lights onto the storage reel.

h. The top portion of the handle provides a storage compartment to hold additional single miniature light bulbs when needing to replace burned out bulbs.

i. Side panels provide a flexible tab facility to secure in place one end of a string of lights to allow the rest of the strand to wind easily around the cylinder of the reel.

j. Invention provides decorating ease. The reel allows for the capability to place lights onto tree, branches while a string of lights are on the reel. The reverse is also true. The string of lights can be removed off the tree directly onto the reel, eliminating the need to lay the lights out on the floor in a straight line before winding lights onto the reel.

k. Invention can be used for indoor and outdoor use.

Further objects and advantages of my invention will become apparent from a consideration of the drawings.

DETAILED DESCRIPTION

Figure 1:
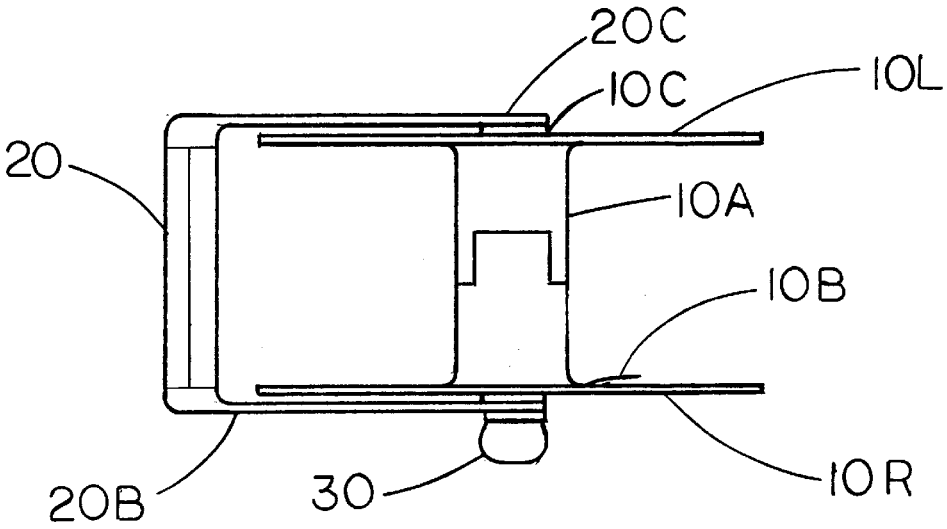
FIG. 1 is a top view of the invention.

FIG. 1. shows a top view of my invention. Sides 10R and 10L are two identical parts which twist and snap together at a 90 degree angle to construct a hollow spool cylinder 10A, which holds a string of lights for storage and decorating purposes. The flexible tab facility 10B secures one end of a string of lights, allowing the remainder string of lights to be wound around the cylinder. Handle 20 has a notched hole 20C at the end of handle which locks/securely over boss 10C. The grip knob 30 of lever 30A is used to rotate a string of lights onto cylinder 10A.

Figure 2:
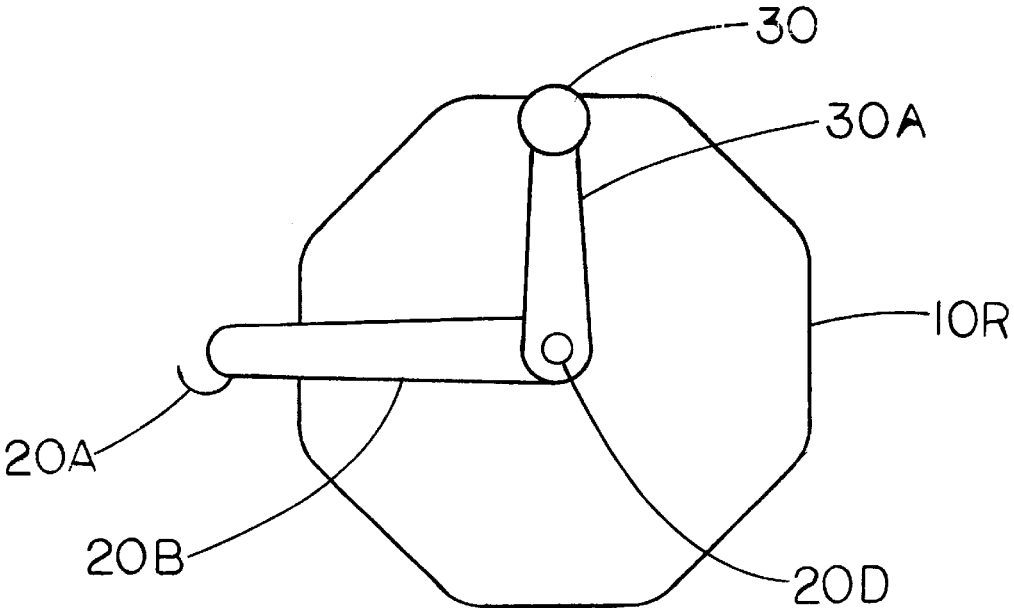
FIG. 2 is a side view of the invention.

FIG. 2 shows that side 10R of the spool cylinder 10A is in the shape of an octagon to allow the reel to be placed in an upright position on a flat surface (side 10L is also in the shape of an octagon). Handle 20 includes a storage compartment with a living hinge 20A between handle sides 20B, 20C shown in its open position. The grip knob 30 connected to the lever 30A allows manual rotationof the spool cylinder.

Figure 3:
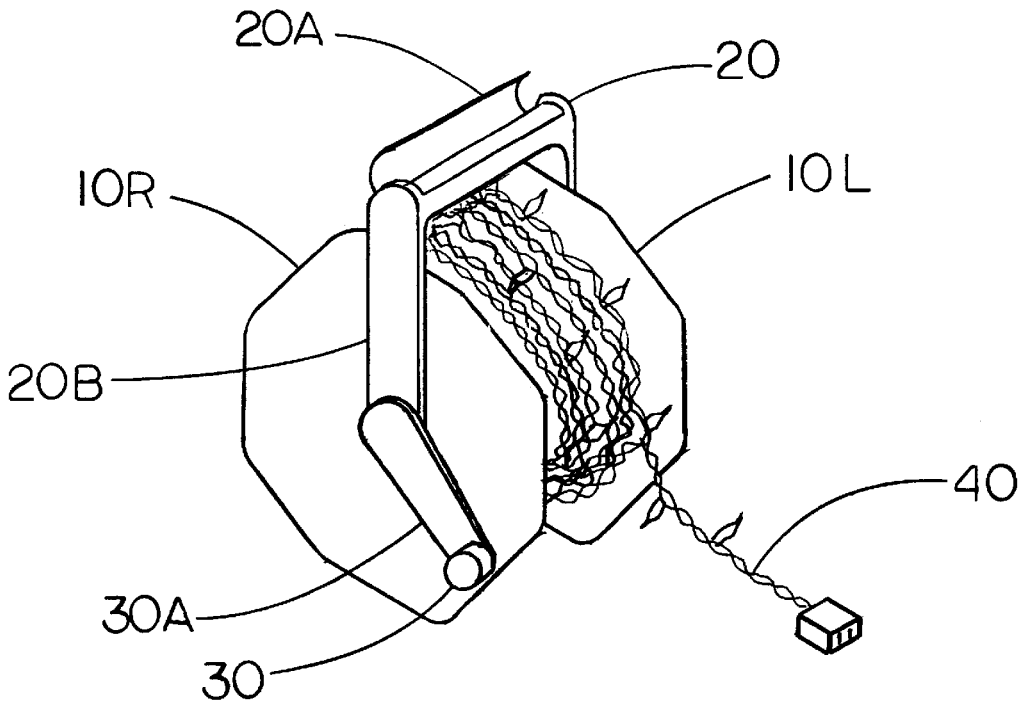
FIG. 3 is a perspective view of the invention with a string of lights wound thereon.

In FIG. 3 is shown a perpective view of the invention with a string of lights having been wound thereon.

Figure 4:
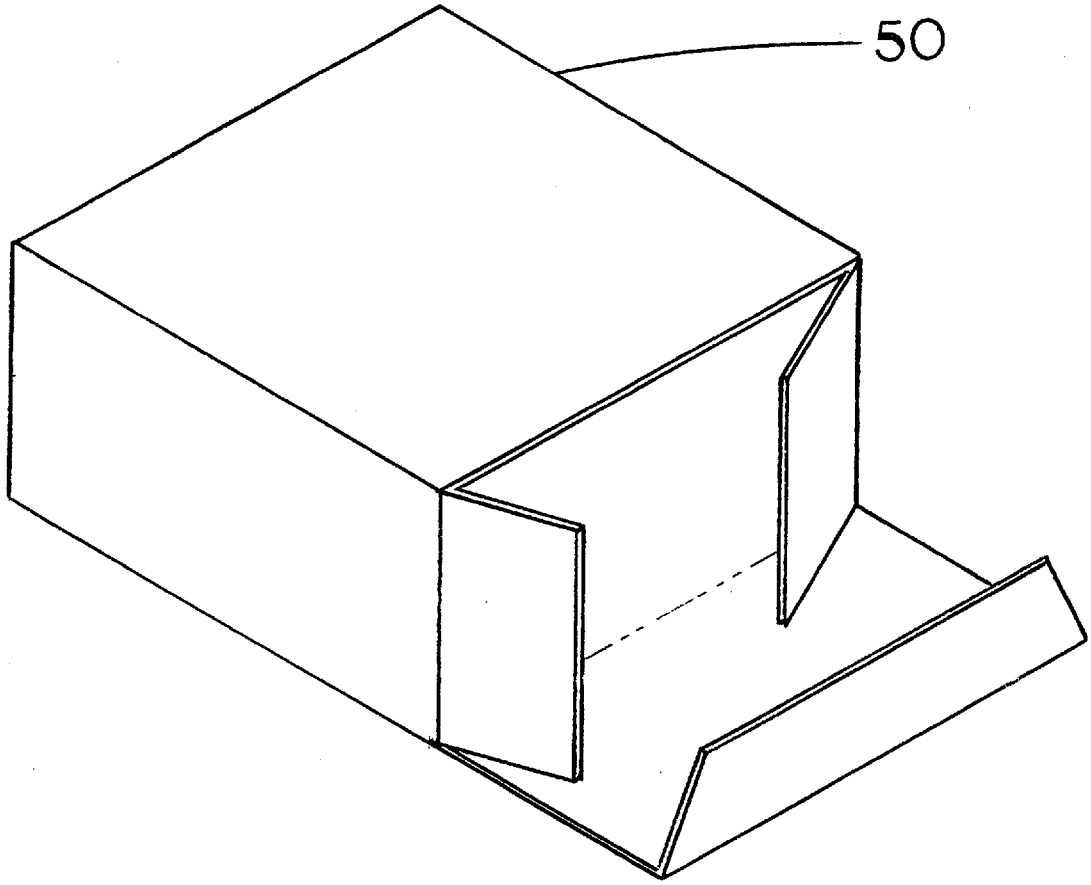
FIG. 4 is a perspective view of a box suitable to store and ship the reel of the invention.

FIG. 4. shows designer box 50 made with appropriate dimensions to securely and safely ship the reel, store the reel, and conveniently shelf stack the box with the reel in it until its next use.

REFERENCE NUMBERS IN DRAWINGS

10R right side of reel

10L left side of reel

10A cylinder

10B Flexible tab facility

10C boss

20 Handle-top view

20A living hinge for bulb storage compartment

20B Handle side view

20C Notched holes at end of handle

20D Outer side center of cylinder

30 Grip knob to rotate lever

30A Rotating lever

40 String of lights on reel

50 Sturdy, durable corrugated cardboard box.

A preferred embodiment of my present invention is illustrated in FIG. 1 and FIG. 2. The sides 10R and 10L create a single unit when both identical plastic molded parts are connected together using a 90 degree twisting snapping motion which creates the cylinder. Associated parts of handle unit 20, 20A, 20B, and 20C is a single molded flexible plastic material which slips over the outer center sides 20D of 10L and 10R by slightly spreading handle 20C over and onto boss 10C, securing the handle in place. A non-restricted free rotating lever 30A has a grip knob 30 used to rotate lever 30A to wind a string of lights onto cylinder 10A.

Alternative Embodiments

There are various possibilities with regard to the use of my invention full aerial view FIG. 3. The Christmas colors of my invention can be changed, but not necessary, to accommodate a different life work to utilize the following materials, but not limited to.

| | |
|---|---|
| a. string | c. cable wire |
| b. twine | d. ribbon |

Still another alternative possibility with regard to the use of my invention, full aerial view FIG. 3, would be to construct the reel with a metal material, example aluminum, which could coil heavy weight matter onto the device. Such as, but not limited to:

| | | |
|---|---|---|
| a. chain | b. electrical cord | c. wire |

Advantages

From the description above a number of advantages of my multiple storage reel becomes evident.

a. my invention is assembled prior to shipping and ready to be conveniently used by the customer. The device is shipped in a sturdy, durable, stackable, corrugated cardboard box so that the customer can easily store the device on a shelf on top of another box in an orderly, handy fashion.

b. my invention is made of a sturdy, durable, lightweight plastic injection molding material. This makes my device affordable and easy to hold in one hand while placing lights on branches with the other hand. This durable material and construction will give the customer years of satisfaction.

c. my invention has great eye appeal, enhancing the joy of the season. The side panels are rich maroon color and the handle lever component is brilliant gold in color. On each of the side panels is a figure of an angel embossed into the molded plastic.

d. my invention is designed with an octagon shape. This design allows the reel to be placed in an upright position on a flat surface, with or with out strand of lights wrapped on the reel.

e. my invention has a flexible tab facility on both sides of the reel on the inner panels to hold in place one end of a string of lights. This process allows the rest of the string of lights to be coiled around the cylinder without delays or annoyances.

f. my invention has a comfortable grip handle. This top portion of the handle is a storage compartment for additional single miniature light bulbs. It is designed with a living hinge for easy to open access. The compartment is similar to how a clam shell opens. Often while decorating a Christmas tree, an individual becomes frustrated looking for additional bulbs to replace burned out ones. This device will eliminate unnecessary frustration which dampen the holiday cheer.

g. my invention has a rotating lever. Attached to the end of this lever is a comfortable fit grip knob used to turn the lever. The lever rotates smoothly, freely and without restrictions. This rotating process coils a string of lights around the cylinder for tangle free decorating of tree branches and hassle free, convenient storage when the Christmas season is over.

j. my invention can be used by either a left handed person or right handed person.

k. My invention can be used to decorate objects other than a Christmas tree. It is portable and can be used to decorate outdoors as well as indoors.

My invention is about 9½ inches in diameter. The cylinder is about 3¾ inches from one end of a side panel to the other end of a side panel, holding 200 miniature string of lights. The handle is 4 inches across having a storage compartment 1 inch deep, capable of holding about 20 single miniature lights.

Operation FIGS. 1, 2, 3, and 4

The manner of using the storage reel after it is removed out of the storage box is to first attach one end of a string of lights, depending on where an individual begins at the top of the tree and works their way down, or using the reverse process, will determine which end (female or male) of the string of lights to secure into the flexible tab facility. Now, place the top of the handle in the palm of one hand and grip the knob of the rotating lever with the fingers of the other hand, and turn the lever. This rotating process will smoothly and evenly wind or unwind a string of lights onto the reel.

Conclusion, Ramifications, and Scope of Invention

Accordingly, the reader will see that the storage reel of my invention provides a highly reliable, lightweight, portable, useful, convenient, long life and economical device for storing miniature Christmas lights. A device which has uniqueness of applications, uniqueness of color and design, and uniqueness of multiple storage purposes.

It provides tangle free storage for string of lights;

It provides lightweight, portable, convenient handling;

It provides a shaped design which allows the device to stand upright;

It provides multiple storage purposes;

The embossed angel and colors provide mood enhancements to the holiday season;

It provides a device that will eliminate frustrations customers begin their holiday season with when struggling to untangle string of lights to decorate the tree;

The colors, design and material can be changed to correspond with different purposes; and The storage compartment of the handle can be eliminated without affecting the purpose of this device.

Although the above descriptions contain many specifications, these should not be construed as limiting the scope of my invention, but merely providing illustrations of some of the previously preferred embodiments of my invention. Thus the scope of my invention should be determined by the appended claims and their legal equivalents.

What is claimed is:

1. Multiple Purpose Storage Reel

A multiple purpose light string storage reel comprising:

a spool having two identical lightweight plastic molded portions which snap together to form a cylinder;

a U-shaped plastic handle having a crank for turning the cylinder, the ends of the handle being flexible to snap over bosses on the outer sides of the spool cylinder;

at least one flexible tab on the spool for engaging an end of a string of lights to be wound on the spool cylinder;

and a storage compartment on the handle for storing single bulbs, the storage compartment having a closure hinged to the handle.

* * * * *